US011151840B2

(12) United States Patent
Hawkins et al.

(10) Patent No.: US 11,151,840 B2
(45) Date of Patent: *Oct. 19, 2021

(54) GAMING MACHINE AND A METHOD OF GAMING THEREON

(71) Applicant: Aristocrat Technologies Australia Pty Limited, North Ryde (AU)

(72) Inventors: Ryan Paul Hawkins, Henderson, NV (US); Yanis Tsombanidis, Las Vegas, NV (US); Stephanie Johns, Las Vegas, NV (US); Robert Honeycutt, Henderson, NV (US)

(73) Assignee: Aristocrat Technologies Australia Pty Limited

( * ) Notice: Subject to any disclaimer, the term of this patent is extended or adjusted under 35 U.S.C. 154(b) by 0 days.

This patent is subject to a terminal disclaimer.

(21) Appl. No.: 16/539,447

(22) Filed: Aug. 13, 2019

(65) Prior Publication Data

US 2019/0371121 A1 Dec. 5, 2019

Related U.S. Application Data

(63) Continuation of application No. 14/868,658, filed on Sep. 29, 2015, now Pat. No. 10,395,475.

(30) Foreign Application Priority Data

Sep. 29, 2014 (AU) ..... 2014903863

(51) Int. Cl.
*G07F 17/32* (2006.01)

(52) U.S. Cl.
CPC ..... *G07F 17/3246* (2013.01); *G07F 17/32* (2013.01)

(58) Field of Classification Search
CPC ... G07F 17/3213; G07F 17/34; G07F 17/3244
See application file for complete search history.

(56) References Cited

U.S. PATENT DOCUMENTS

| | | | | |
|---|---|---|---|---|
| 8,602,868 | B2 * | 12/2013 | Johnson | G07F 17/3267 463/20 |
| 8,777,720 | B2 | 7/2014 | Kelly | |
| 8,795,059 | B2 | 8/2014 | Aoki | |
| 10,026,257 | B2 | 7/2018 | Hawkins | |
| 2005/0159208 | A1 | 7/2005 | Pacey | |
| 2006/0247002 | A1 | 11/2006 | Yoshimi | |

(Continued)

OTHER PUBLICATIONS

Examination Report No. 1 for Australian Patent Application No. 2018278980 dated Feb. 25, 2020, 3 pages.

*Primary Examiner* — Malina D. Blaise
(74) *Attorney, Agent, or Firm* — McAndrews, Held & Malloy, Ltd.

(57) ABSTRACT

Described herein is a gaming machine and, a method of gaming thereon, comprising: a symbol selector for selecting a plurality of symbols from a set of symbols during play of a game, the set of symbols including a plurality of function symbols; a display having at least a game area, the selected symbols being displayed in said game area; an outcome evaluator for determining that at least one predefined triggering criterion is satisfied; and a game area expander for expanding said game area in response to said at least one predefined triggering criterion being satisfied, such that at least one additional symbol of the set of symbols is displayed in an expanded game area.

19 Claims, 9 Drawing Sheets

(56) References Cited

U.S. PATENT DOCUMENTS

| | | | | |
|---|---|---|---|---|
| 2006/0287036 | A1 | 12/2006 | Daly | |
| 2009/0186686 | A1 | 7/2009 | Shai-Hee | |
| 2009/0239634 | A1 | 9/2009 | Nguyen | |
| 2013/0324213 | A1 | 12/2013 | Aoki | |
| 2014/0031100 | A1 | 1/2014 | Gomez | |
| 2014/0094249 | A1* | 4/2014 | Gugler | G07F 17/34 463/20 |
| 2014/0121000 | A1 | 5/2014 | Porter | |
| 2014/0243069 | A1 | 8/2014 | Hoffman | |
| 2014/0256411 | A1* | 9/2014 | Basallo | G07F 17/3246 463/25 |
| 2014/0274288 | A1 | 9/2014 | Hornik | |
| 2015/0161853 | A1 | 6/2015 | Ryan | |
| 2015/0379831 | A1 | 12/2015 | Lee | |
| 2016/0078711 | A1 | 3/2016 | Rucker | |
| 2016/0093148 | A1 | 3/2016 | Hawkins | |
| 2016/0314661 | A1 | 10/2016 | Vann | |
| 2017/0024957 | A1 | 1/2017 | Boese | |

* cited by examiner

GAMING MACHINE AND A METHOD OF GAMING THEREON

RELATED APPLICATIONS

The present application is a continuation of U.S. patent application Ser. No. 14/868,658, filed Sep. 29, 2015, which claims priority to Australian Provisional Patent Application No. 2014903863, having a filing date of Sep. 29, 2014. Each of the above-mentioned applications are hereby incorporated herein by reference in their entirety.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

In existing gaming systems, feature games may be triggered for players in addition to the base game. A feature game gives players an additional opportunity to win prizes, or the opportunity to win larger prizes, than would otherwise be available in the base game. Feature games can also offer altered game play to enhance player enjoyment.

While such gaming systems provide players with enjoyment, a need exists for alternative methods to provide feature games in gaming systems, and for a larger variety of types of feature games, in order to maintain or increase player enjoyment.

BRIEF SUMMARY OF THE INVENTION

According to one aspect of the invention there is provided a gaming machine comprising:

a symbol selector for selecting a plurality of symbols from a set of symbols during play of a game, the set of symbols including a plurality of function symbols;

a display having at least a game area, the selected symbols being displayed in said game area;

an outcome evaluator for determining that at least one predefined triggering criterion is satisfied; and a game area expander for expanding said game area in response to said at least one predefined triggering criterion being satisfied, such that at least one additional symbol of the set of symbols is displayed in an expanded game area.

In one embodiment, the symbol selector comprises a first reel having a plurality of first symbol positions and a second reel having a plurality of second symbol positions, wherein the plurality of symbols are selected for positioning in a respective one of the plurality of first and second symbol positions, the first reel and the second reel being positioned on the display such that at least one symbol position from each reel is active and is viewable in the game area and such that at least one symbol position from each reel is non-active and is not viewable in the game area.

In such embodiments, the expanded game area preferably comprises expanding the game area such that the at least one non-active symbol position from each reel that is not viewable in the original game area becomes active and becomes viewable in the expanded game area.

In one embodiment, the predefined criterion comprises a function symbol being selected for positioning in an active first symbol position that is aligned with a function symbol being selected for positioning in a non-active second symbol position.

In one embodiment, expanding of the game area continues until at least one predefined ending criterion is satisfied.

In such embodiments, the predefined ending criterion comprises determining whether a function symbol is selected for positioning in a non-active symbol position that is located adjacent to an aligned function symbol in the same reel. In response to determining that a function symbol is selected for positioning in a non-active symbol position that is located adjacent to an aligned function symbol in the same reel, the adjacent non-active symbol position becomes active and is displayed in the expanded game area.

Further, a non-active symbol position located on one reel adjacent to an active symbol position located on another reel becomes active and is displayed in the expanded game area.

In this or other embodiments, the predefined ending criterion further comprises a predefined expansion limit, wherein the expanding continues until the predefined expansion limit is reached.

According to another aspect of the invention there is provided a method of playing a game on a gaming machine, the method comprising:

selecting using a symbol selector a plurality of symbols from a set of symbols during play of a game, the set of symbols including a plurality function symbols;

displaying on a display having at least a game area, the selected symbols being displayed in said game area; and determining using an outcome evaluator that at least one predefined triggering criterion is satisfied during play of said game; and expanding using a game area expander said game area in response to said at least one predefined triggering criterion being satisfied, such that at least one additional symbol of the set of symbols is displayed in an expanded game area.

According to another aspect of the invention there is provided a computer program code which when executed by components of a controller of a gaming system implements the above method.

According to another aspect of the invention there is provided a tangible computer readable medium comprising the above computer program code.

BRIEF DESCRIPTION OF SEVERAL VIEWS OF THE DRAWINGS

Features and advantages of certain embodiments of the present invention will become apparent from the following description of embodiments thereof, by way of example only, with reference to the accompanying drawings, in which.

Figure 1:
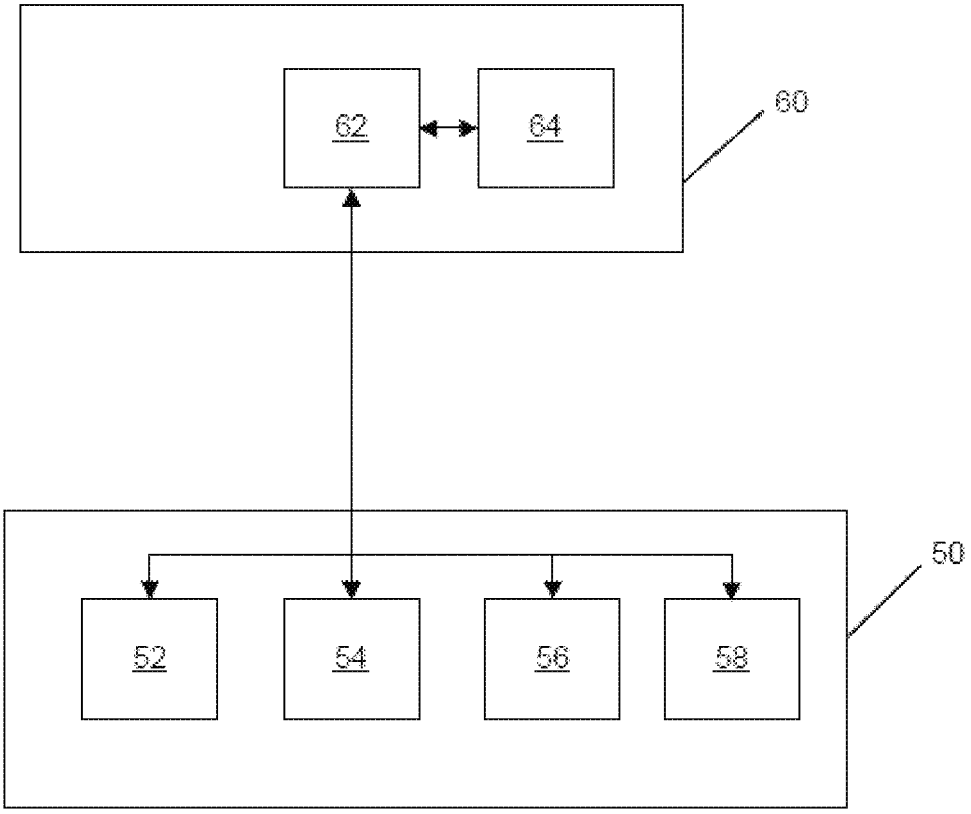
FIG. 1 is a block diagram of the core components of a gaming system.

The foregoing summary, as well as the following detailed description of certain embodiments of the present invention, will be better understood when read in conjunction with the appended drawings. For the purpose of illustrating the invention, certain embodiments are shown in the drawings. It should be understood, however, that the present invention is not limited to the arrangements and instrumentality shown in the attached drawings.

DETAILED DESCRIPTION OF THE INVENTION

Referring to the drawings, there are shown example embodiments of gaming systems which have components that are arranged to implement a base game, from which may be triggered a feature game. In these embodiments, symbols are selected from a set of symbols comprising at least a plurality of function symbols. In the feature game, a game area on the display is caused to expand so that additional symbols may be displayed in a game area of the display. The invention is not limited to expanding the game area in only a feature game, however. In other embodiments, the game area may be expanded in any part of the game. In embodiments of the invention, the game area is expanded while an alignment test is satisfied in respect of designated symbols in active and inactive symbol display positions.

General Construction of Gaming System

The gaming system can take a number of different forms. In a first form, a stand alone gaming machine is provided wherein all or most components required for implementing the game are present in a player operable gaming machine.

In a second form, a distributed architecture is provided wherein some of the components required for implementing the game are present in a player operable gaming machine and some of the components required for implementing the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in stand alone gaming machine mode, "thick client" mode or "thin client" mode depending on the game being played, operating conditions, and so on. Other variations will be apparent to persons skilled in the art.

Irrespective of the form, the gaming system 1 has several core components. At the broadest level, the core components are a player interface 50 and a game controller 60 as illustrated in FIG. 1. The player interface is arranged to enable manual interaction between a player and the gaming system and for this purpose includes the input/output components required for the player to enter instructions to play the game and observe the game outcomes.

Components of the player interface may vary from embodiment to embodiment but will typically include a credit mechanism 52 to enable a player to input credits and receive payouts, one or more displays 54, a game play mechanism 56 including one or more input devices that enable a player to input game play instructions (e.g. to place a wager), and one or more speakers 58.

The game controller 60 is in data communication with the player interface and typically includes a processor 62 that processes the game play instructions in accordance with game play rules and outputs game play outcomes to the display. Typically, the game play rules are stored as program code in a memory 64 but can also be hardwired. Herein the term "processor" is used to refer generically to any device that can process game play instructions in accordance with game play rules and may include: a microprocessor, microcontroller, programmable logic device or other computational device, a general purpose computer (e.g. a PC) or a server. That is a processor may be provided by any suitable logic circuitry for receiving inputs, processing them in accordance with instructions stored in memory and generating outputs (for example on the display). Such processors are sometimes also referred to as central processing units (CPUs). Most processors are general purpose units, however, it is also know to provide a specific purpose processor using an application specific integrated circuit (ASIC) or a field programmable gate array (FPGA).

Figure 2:
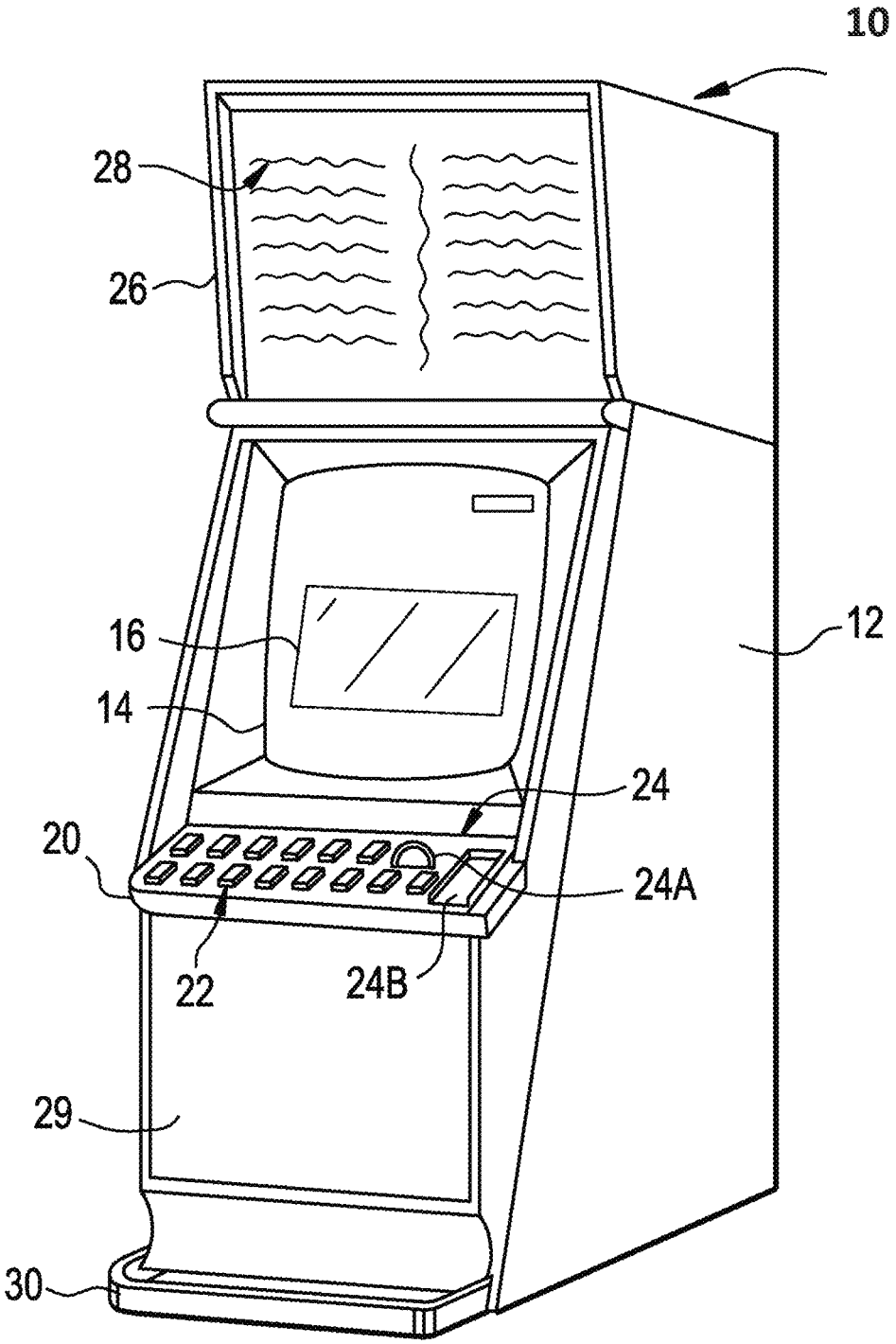
FIG. 2 is a perspective view of a stand alone gaming machine.

A gaming system in the form of a stand alone gaming machine 10 is illustrated in FIG. 2. The gaming machine 10 includes a console 12 having a display 14 on which are displayed representations of a game 16 that can be played by a player. A mid-trim 20 of the gaming machine 10 houses a bank of buttons 22 for enabling a player to interact with the gaming machine, in particular during game play. The mid-trim 20 also houses a credit input mechanism 24 which in this example includes a coin input chute 24A and a bill collector 24B. Other credit input mechanisms may also be employed, for example, a card reader for reading a smart card, debit card or credit card. Other gaming machines may configure for ticket in such that they have a ticket reader for reading tickets having a value and crediting the player based on the face value of the ticker. A player marketing module (not shown) having a reading device may also be provided for the purpose of reading a player tracking device, for example as part of a loyalty program. The player tracking device may be in the form of a card, flash drive or any other portable storage medium capable of being read by the reading device. In some embodiments, the player marketing module may provide an additional credit mechanism, either by transferring credits to the gaming machine from credits stored on the player tracking device or by transferring credits from a player account in data communication with the player marketing module.

A top box 26 may carry artwork 28, including for example pay tables and details of bonus awards and other information or images relating to the game. Further artwork and/or information may be provided on a front panel 29 of the console 12. A coin tray 30 is mounted beneath the front panel 29 for dispensing cash payouts from the gaming machine 10.

The display 14 shown in FIG. 2 is in the form of a video display unit, particularly a cathode ray tube screen device. Alternatively, the display 14 may be a liquid crystal display, plasma screen, any other suitable video display unit, or the visible portion of an electromechanical device. The top box 26 may also include a display, for example a video display unit, which may be of the same type as the display 14, or of a different type.

Figure 3:
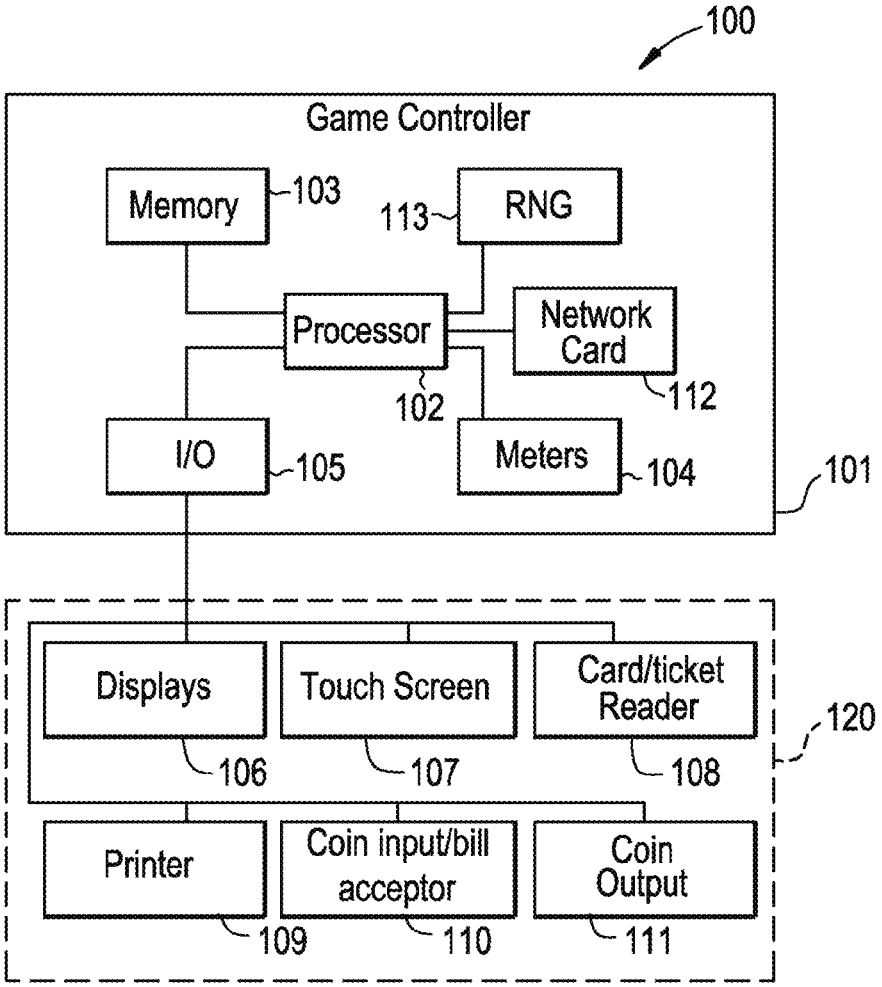
FIG. 3 is a block diagram of the functional components of a gaming machine.

FIG. 3 shows a block diagram of operative components of a typical gaming machine which may be the same as or different to the gaming machine of FIG. 2.

The gaming machine 10 includes a game controller 101 having a processor 102 mounted on a circuit board. Instructions and data to control operation of the processor 102 are stored in a memory 103, which is in data communication with the processor 102. Typically, the gaming machine 10 will include both volatile and non-volatile memory and more than one of each type of memory, with such memories being collectively represented by the memory 103.

The gaming machine has hardware meters 104 for purposes including ensuring regulatory compliance and monitoring player credit, an input/output (I/O) interface 105 for communicating with peripheral devices of the gaming machine 100. The input/output interface 105 and/or the peripheral devices may be intelligent devices with their own memory for storing associated instructions and data for use with the input/output interface or the peripheral devices. A random number generator module 113 generates random numbers for use by the processor 102. Persons skilled in the art will appreciate that the reference to random numbers includes pseudo-random numbers.

In the example shown in FIG. 3, a player interface 120 includes peripheral devices that communicate with the game controller 101 including one or more displays 106, a touch screen and/or buttons 107 (which provide a game play mechanism), a card and/or ticket reader 108, a printer 109, a bill acceptor and/or coin input mechanism 110 and a coin output mechanism 111. Additional hardware may be included as part of the gaming machine 100, or hardware may be omitted as required for the specific implementation. For example, while buttons or touch screens are typically used in gaming machines to allow a player to place a wager and initiate a play of a game any input device that enables the player to input game play instructions may be used. For example, in some gaming machines a mechanical handle is used to initiate a play of the game. Persons skilled in the art will also appreciate that a touch screen can be used to emulate other input devices, for example, a touch screen can display virtual buttons which a player can "press" by touching the screen where they are displayed.

In addition, the gaming machine 100 may include a communications interface, for example a network card 112. The network card may, for example, send status information, accounting information or other information to a bonus controller, central controller, server or database and receive data or commands from the bonus controller, central controller, server or database. In embodiments employing a player marketing module, communications over a network may be via player marketing module—i.e. the player marketing module may be in data communication with one or more of the above devices and communicate with it on behalf of the gaming machine.

Figure 4:
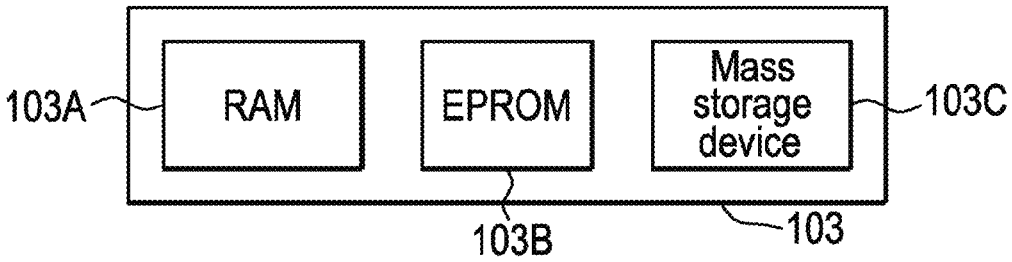
FIG. 4 is a schematic diagram of the functional components of a memory.

FIG. 4 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

It is also possible for the operative components of the gaming machine 100 to be distributed, for example input/output devices 106,107,108,109,110,111 to be provided remotely from the game controller 101.

Figure 5:
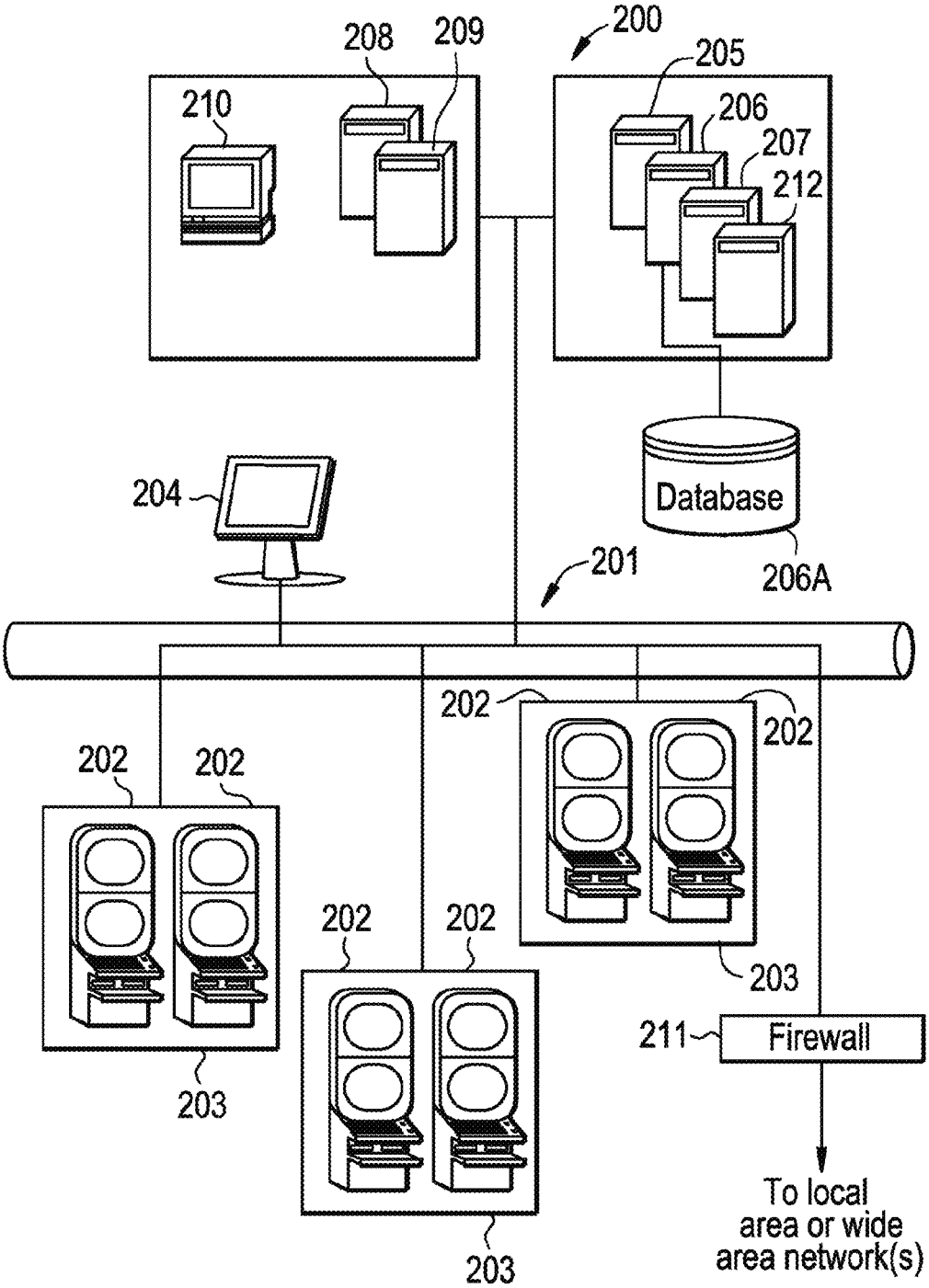
FIG. 5 is a schematic diagram of a network gaming system.

FIG. 5 shows a gaming system 200 in accordance with an alternative embodiment. The gaming system 200 includes a network 201, which for example may be an Ethernet network. Gaming machines 202, shown arranged in three banks 203 of two gaming machines 202 in FIG. 5 are connected to the network 201. The gaming machines 202 provide a player operable interface and may be the same as the gaming machines 10,100 shown in FIGS. 2 and 3, or may have simplified functionality depending on the requirements for implementing game play. While banks 203 of two gaming machines are illustrated in FIG. 5, banks of one, three or more gaming machines are also envisaged.

One or more displays 204 may also be connected to the network 201. For example, the displays 204 may be associated with one or more banks 203 of gaming machines. The displays 204 may be used to display representations associated with game play on the gaming machines 202, and/or used to display other representations, for example promotional or informational material.

In a thick client embodiment, game server 205 implements part of the game played by a player using a gaming machine 202 and the gaming machine 202 implements part of the game. With this embodiment, as both the game server and the gaming device implement part of the game, they collectively provide a game controller. A database management server 206 may manage storage of game programs and associated data for downloading or access by the gaming devices 202 in a database 206A. Typically, if the gaming system enables players to participate in a Jackpot game, a Jackpot server 207 will be provided to perform accounting functions for the Jackpot game. A loyalty program server 212 may also be provided.

In a thin client embodiment, game server 205 implements most or all of the game played by a player using a gaming machine 202 and the gaming machine 202 essentially provides only the player interface. With this embodiment, the game server 205 provides the game controller. The gaming machine will receive player instructions, pass these to the game server which will process them and return game play outcomes to the gaming machine for display. In a thin client embodiment, the gaming machines could be computer terminals, e.g. PCs running software that provides a player interface operable using standard computer input and output components. Other client/server configurations are possible, and further details of a client/server architecture can be found in WO 2006/052213 and PCT/SE2006/000559, the disclosures of which are incorporated herein by reference.

Servers are also typically provided to assist in the administration of the gaming network 200, including for example a gaming floor management server 208, and a licensing server 209 to monitor the use of licenses relating to particular games. An administrator terminal 210 is provided to allow an administrator to run the network 201 and the devices connected to the network.

The gaming system 200 may communicate with other gaming systems, other local networks, for example a corporate network, and/or a wide area network such as the Internet, for example through a firewall 211.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random generator engine. Alternatively, a separate random number generator server could be provided. Further, persons skilled in the art will appreciate that a plurality of game servers could be provided to run different games or a single game server may run a plurality of different games as required by the terminals.

Further Detail of Gaming System

The player operates the game play mechanism 56 to specify a wager and hence the win entitlement which will be evaluated for this play of the game and initiates a play of the game. Persons skilled in the art will appreciate that a player's win entitlement will vary from game to game dependent on player selections. In most spinning reel games, it is typical for the player's entitlement to be affected by the amount they wager and selections they make (i.e. the nature of the wager). For example, a player's win entitlement may be based on how many lines they play in each game—e.g. a minimum of one line up to the maximum number of lines allowed by the game (noting that not all permutations of win lines may be available for selection) and how much they wager per line. Such win lines are typically formed by a combination of symbol display positions, one from each reel, the symbol display positions being located relative to one another such that they form a line.

In many games, the player's win entitlement is not strictly limited to the lines they have selected, for example, "scatter" pays are awarded independently of a player's selection of paylines and are an inherent part of the win entitlement.

Persons skilled in the art will appreciate that in other embodiments, the player may obtain a win entitlement by selecting a number of reels to play and an amount to wager. Such games are marketed under the trade name "Reel Power" by Aristocrat Leisure Industries Pty Ltd. The selection of the reel means that each displayed symbol of the reel can be substituted for a symbol at one or more designated display positions. In other words, all symbols displayed at symbol display positions corresponding to a selected reel can be used to form symbol combinations with symbols displayed at a designated, symbol display positions of the other reels. For example, if there are five reels and three symbol display positions for each reel such that the symbol display positions comprise three rows of five symbol display positions, the symbols displayed in the centre row are used for non-selected reels. As a result, the total number of ways to win is determined by multiplying the number of active display positions of each reel, the active display positions being all display positions of each selected reel and the designated display position of the non-selected reels. As a result for five reels and fifteen display positions there are 243 ways to win.

Figure 6:
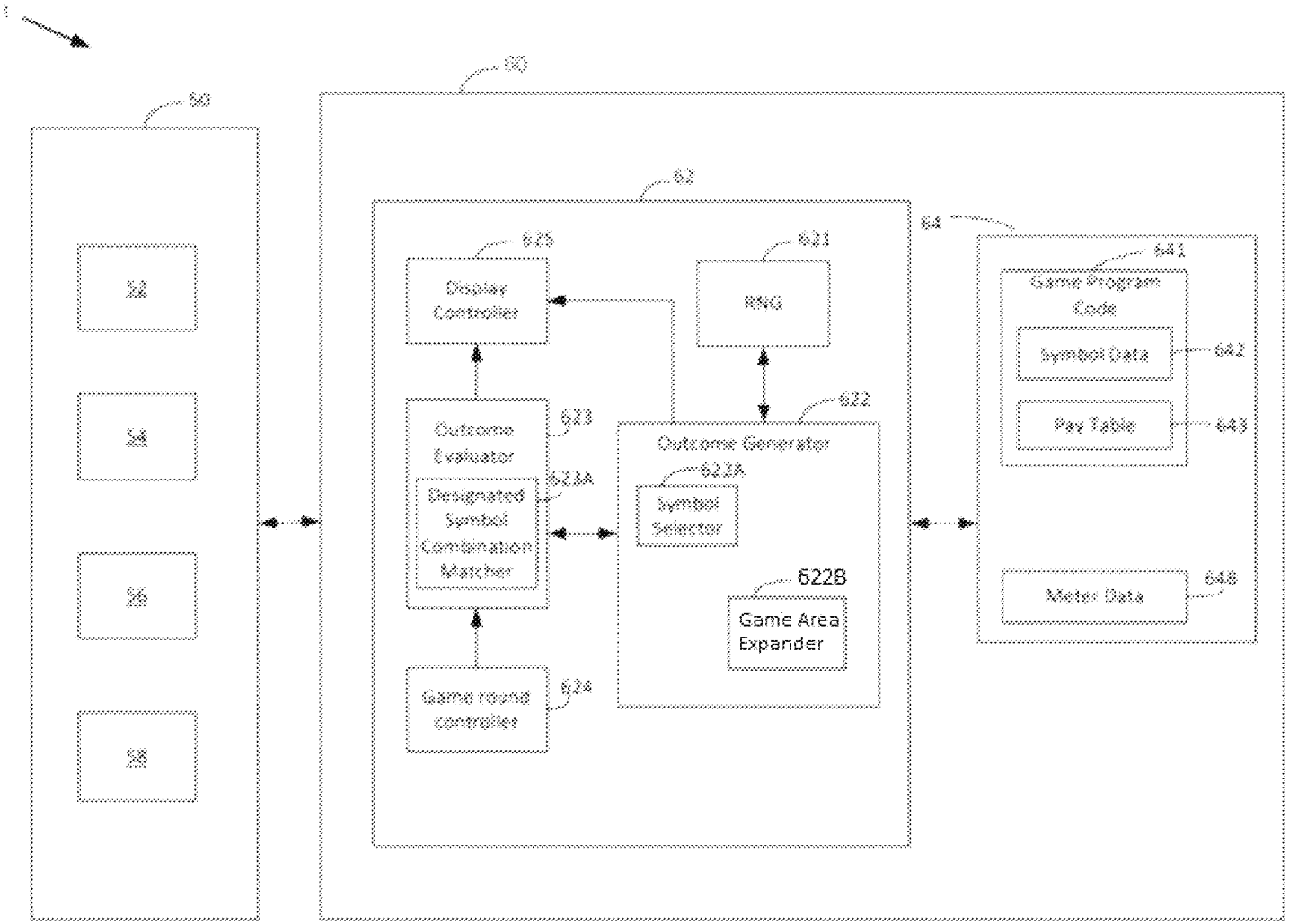
FIG. 6 is a further block diagram of a gaming system.

In FIG. 6, the processor 62 of game controller 60 of gaming system 1 is shown implementing a number of modules based on game program code 641 stored in memory 64. Persons skilled in the art will appreciate that various of the modules could be implemented in some other way, for example by a dedicated circuit.

These modules include the outcome generator 622 which operates in response to the player's operation of game play mechanism 56 to place a wager and initiate a play of the game and generates a game outcome which will then be evaluated by outcome evaluator 623. The first part of forming the game outcome is for a symbol selector 622A to select symbols from a set of symbols specified by symbol data 642 using random number generator 621. The selected symbols are advised to the display controller 625 which causes them to be displayed as a symbol display on display 54 at a set of display positions.

In the embodiment described below, the display positions of the symbol display are arranged in a rectangular matrix comprising a plurality of columns and a plurality of rows. However, in other arrangements as known in the gaming industry could be employed in embodiments of the invention. For example, in some arrangements there are more symbols in some columns than other, such as 3-4-3-4-3 arrangement of seventeen display positions corresponding to respective ones of five reels. In such arrangements, the columns of four symbols can be arranged so that they are off-set or staggered relative to the columns having two symbols so that the middle two symbols in the columns of four symbols share boundaries with two symbols of each neighbouring reel.

Figure 7:
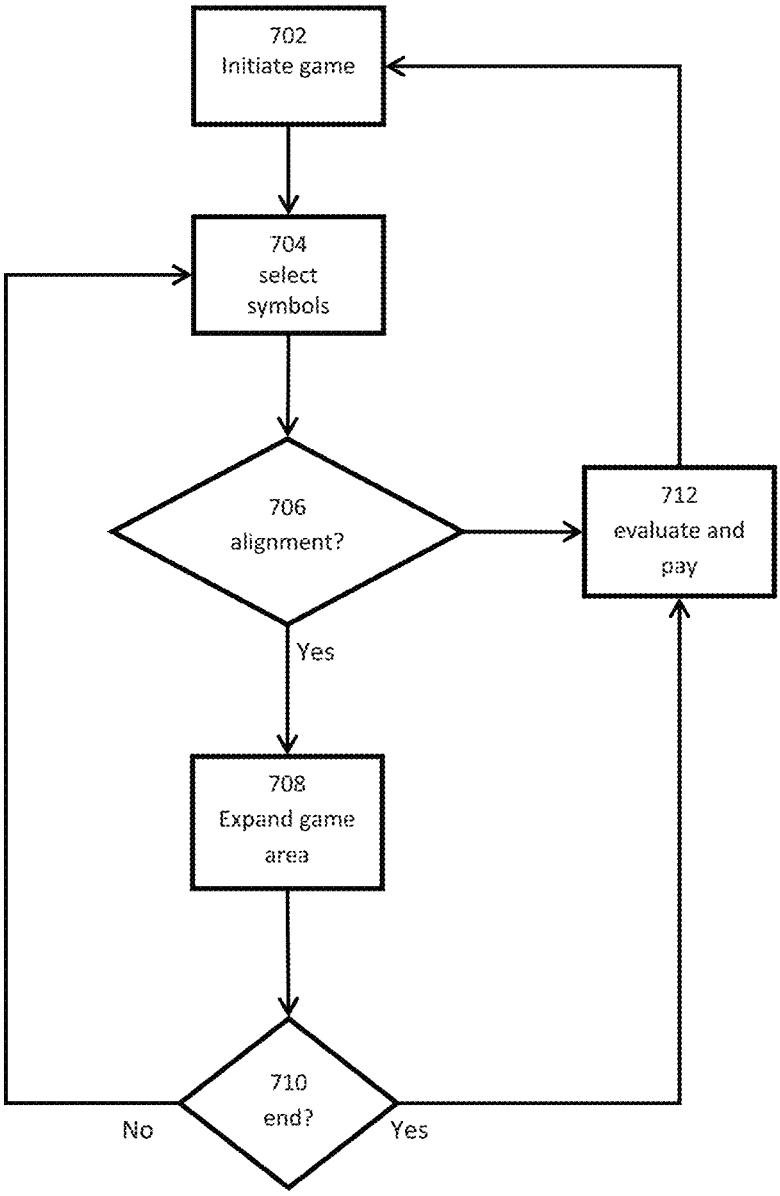
FIG. 7 is a flow diagram of a feature game of the gaming machine of FIG. 2.

FIG. 7 shows a flow diagram of one embodiment, in which a game area may be expanded during play of a game. The game, in this embodiment a feature game, is initiated at step 702. A feature game may be triggered for example during play of a base game, or by any method known to those skilled in the art. Base games and the triggering of feature games is not discussed further herein.

Figure 8:
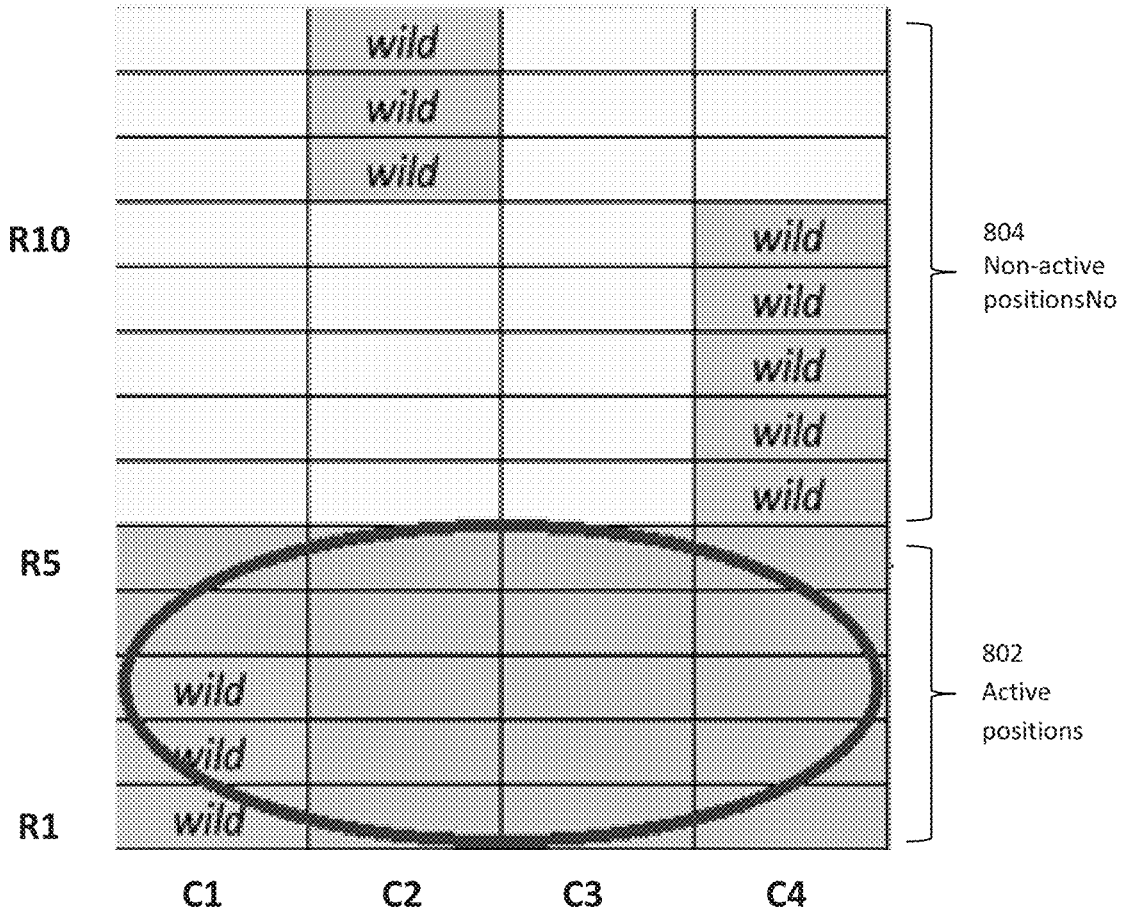
FIG. 8 is a schematic representation of active and non-active symbol positions of the feature game of FIG. 7.

At step 704, symbol selector 622*a* selects symbols from symbol data 642 for positioning in active symbol positions 802 and non-active symbol positions 804, as best shown in FIG. 8. Further, in the FIG. 8 embodiment, game area 808 (circled) is aligned with active symbol positions 804 so that any symbols selected for positioning in the active symbol positions are viewable on one or more displays 54.

Once symbols are selected for positioning in the active and non-active symbol positions, outcome evaluator 623 determines whether a trigger condition is satisfied at step 706. In one embodiment, the feature expands game area 808 and is triggered when an alignment test holds true. In other embodiments, the expansion feature is triggered by any triggering mechanism that is known in the art, and the alignment test is only applied only when the feature has been triggered.

In one embodiment, the alignment test holds true when outcome evaluator 623 determines that:

1. A function symbol is selected for positioning in an active symbol position; and 2. A function symbol positioned in an active symbol position is aligned with a function symbol positioned in a non-active symbol position.

Note that in this embodiment, function symbols are implemented as wild symbol 806. The function of wild symbol 806 is to act as a replacement symbol for any other symbol making up the set of symbols. In other embodiments, the wild symbol may only act as a replacement symbol for a subset of the set of symbols, such as all symbols except for scatter symbols. In some embodiments, the function symbol may be implemented as a symbol other than a wild symbol, such as a multiplier. The function of a multiplier may be to multiply any prizes won, or to multiply the number of free games won, etc., when that multiplier symbol is included in a predetermined winning symbol combination.

In one embodiment, "alignment" refers vertical alignment in which wild symbols 806 are selected for positioning in adjacent active and non-active symbol positions on the same reel. That is, wild symbol 806 is selected for positioning in a non-active position 804 that happens to be adjacent to a wild symbol 806 that is selected for positioning in an active position 802. This is discussed in more detail below with reference to the examples and to FIGS. 9A to 10C.

Alternatively or additionally, "alignment" may also refer to horizontal alignment in which a wild symbol 806 is selected for positioning in an active symbol position of a first reel that is adjacent a wild symbol 806 selected for positioning in a non-active symbol position of a second reel. Again, this is discussed further below with reference to the examples and to FIGS. 9A to 10C.

Thus, in the embodiments above, the alignment test holds true when active and non-active symbol positions in either or both horizontal and vertical positions are aligned. In other embodiments, the alignment test may also include alignment of the symbol positions in other directions, such as diagonally or, in the case of three-dimensional games, in front of or behind a selected symbol position.

If the trigger condition is not satisfied, the game area is again evaluated by outcome evaluator 623, and any awards are paid at step 712. In one embodiment, awards are paid according to a predefined pay table 643, which defines the magnitude and/or the nature of the award according to combinations formed by symbols selected for display in the active symbol positions 802 in game area 808. Once paid, the game ends and control returns to step 702.

If the alignment test holds true, outcome evaluator 623 sends a message to game area expander 622B to expand game area 808 at step 708. The extent that the game area is expanded is determined by the alignment of the active and non-active symbol positions as discussed above, and continues until an end condition is satisfied at step 710.

In an embodiment, game area expander 622B expands game area 808 indefinitely so long as the alignment test holds true. That is, the end condition at step 710 is that the alignment test fails. In other embodiments, the end condition is a predefined expansion limit. Thus, if the original game area is defined as an array having 4 columns and 5 rows, the expansion limit, may be defined as an array having 4 columns and 13 rows. That is, in such embodiments, the game area may grow from 5×4 to 13×4. The expansion limit may be defined in terms of for example rows, columns, total symbol positions, or any combination thereof. Note that both end conditions may be implemented for some embodiments, and game area 808 ceases expanding for whichever end condition is satisfied first. Note also that in some embodiments, more than or less than two end conditions may be implemented.

At step 710, if the end condition is satisfied, the game area is again evaluated by outcome evaluator 623, and any awards are paid at step 712. Once paid, the game ends and control returns to step 702.

If the end condition is not satisfied, control returns to step 704 and game area expander 622B continues to expand game area 808 until outcome evaluator 623 determines that the alignment test has failed, or another end condition has been satisfied.

EXAMPLES

More specific examples of embodiments of the invention are now described with reference to FIGS. 9A to 10C. In general, as shown in these Figures, the game is implemented using a 5×4 grid layout. Of course, the game is not limited to being implemented using such a grid layout, and may be implemented by a game designer as desired. Furthermore, in these Figures, game area 808 is indicated by the shaded cells. As noted above, the cells within game area 808 are indicative of active symbol positions 802, while the cells outside of game area 808 are indicative of non-active symbol positions 804.

Figure 9C:
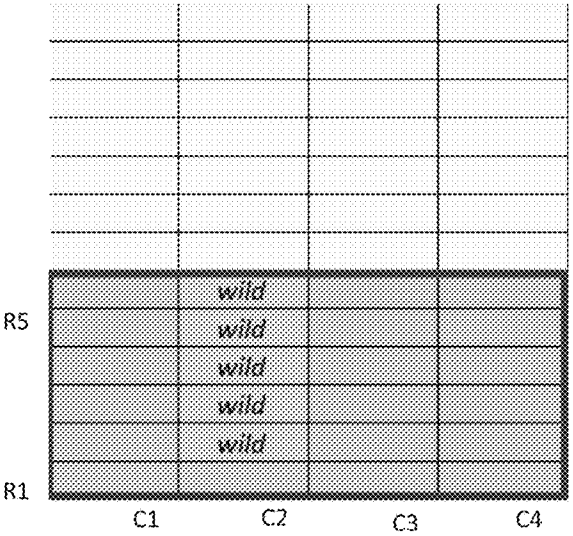
FIGS. 9A to 9C and 10A to 10C are schematic representations of the game area and expanded game area of the feature game of FIG. 7.
Figure 9B:
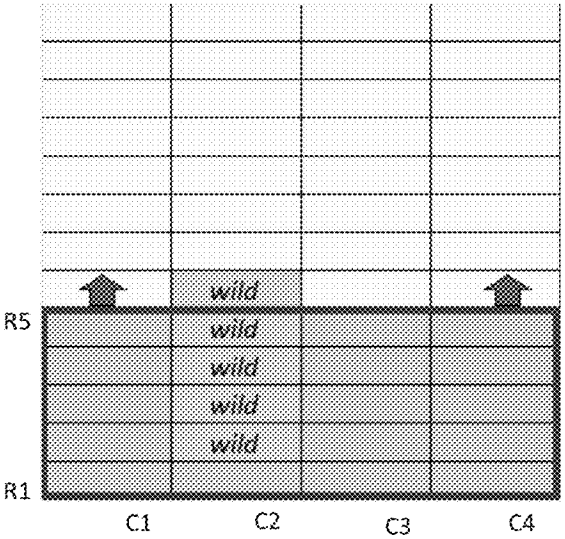
Figure 9A:
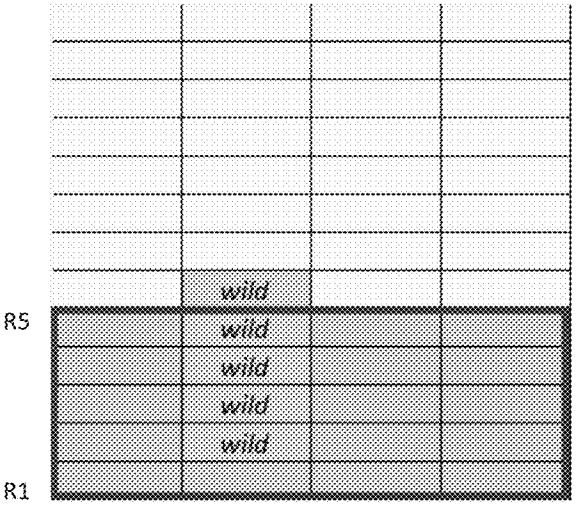

Starting at FIG. 9A, wild symbols 806 have been selected for positioning in active symbol positions R2 to R5 of column 2. A wild symbol 806 has also been selected for positioning in non-active symbol position R6C2.

Outcome evaluator 623 determines that there is a wild symbol 806 positioned in a non-active symbol position 804 at R6C2; and that this particular non-active symbol position is adjacent to a wild symbol 806 positioned in an active symbol position 802 at R5C2. Accordingly, outcome evaluator 623 determines that the alignment test holds true and sends a message to game area expander 622B to expand the game area 808.

In one embodiment, game area expander 622B in turn sends a message to display controller 625, which causes an animation to be displayed on display 54, as illustrated in FIG. 9B. That is, arrow object 902 is displayed on display 54 indicating the direction and magnitude of expansion of game area 808.

The result following expansion of the game area is shown at FIG. 9C, in which expanded game area 904 is defined by a 6×4 grid layout. That is, R6 which was originally inactive is now activated and forms part of the expanded game area 904, as shown by the shaded cells of FIG. 9C.

At this point, since there are no more wild symbols 806 positioned in a non-active symbol position aligned with a wild symbol 806 positioned in an active symbol position 802, the alignment test fails and expansion of the game area ends. That is, referring to FIGS. 6 and 7, outcome evaluator 623 determines that the end condition is satisfied at step 710, evaluates the symbols selected for positioning in active symbol positions 802, pays any awards due based on predefined pay table 643 and returns control back to step 702.

Figure 10A:
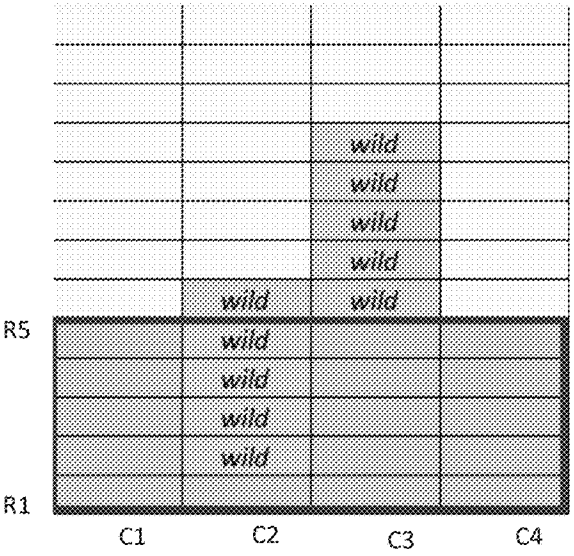

Now referring to FIG. 10A, wild symbols 806 have been selected for positioning in active symbol positions R2 to R5 of column 2. A wild symbol 806 has also been selected for positioning in non-active symbol position R6C2. Furthermore, wild symbols 806 have also been selected for positioning in non-active symbol positions R6 to R10 of column 3.

Outcome evaluator 623 first determines that there is a wild symbol 806 positioned in a non-active symbol position 804 at R6C2; and that this particular non-active symbol position is adjacent to a wild symbol 806 positioned in an active symbol position 802 at R5C2.

Accordingly, outcome evaluator 623 determines that the alignment test holds true and sends a message to game area expander 622B to expand the game area 808.

Figure 10B:
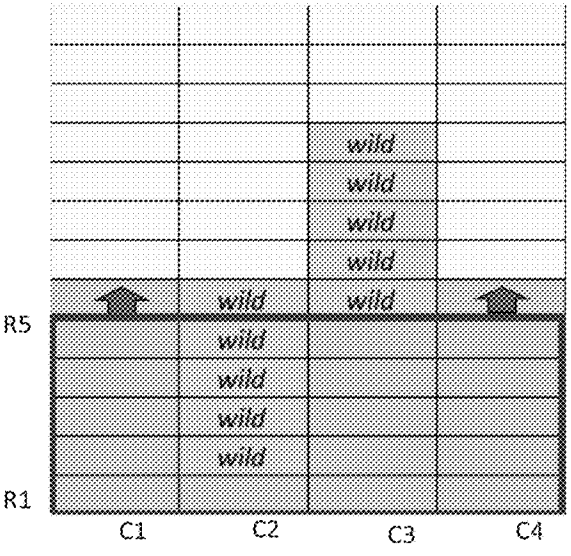

In one embodiment, game area expander 622B in turn sends a message to display controller 625, which causes an animation to be displayed on display 54, as illustrated in FIG. 10B. That is, arrow object 902 is displayed on display 54 indicating the direction and magnitude of expansion of game area 808.

Figure 10C:
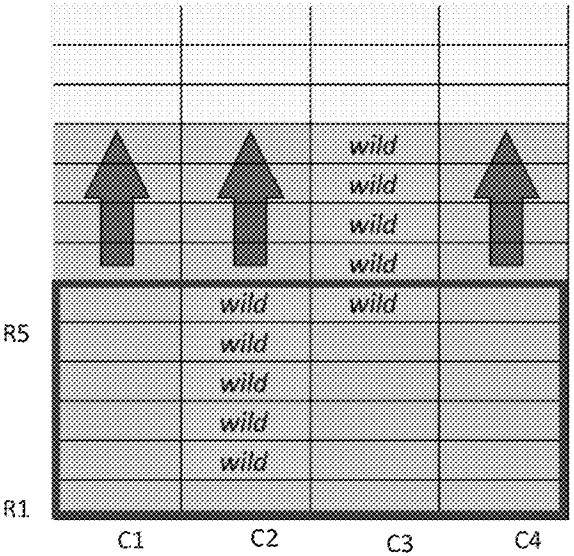

The result following expansion of the game area is shown at FIG. 10C, in which expanded game area 904 is defined by a 6×4 grid layout. That is, R6 which was originally inactive is now activated and forms part of the expanded game area 904.

Outcome evaluator 623 then determines that there is a wild symbol 806 positioned in a non-active symbol position 804 at R6C3; and that this particular non-active symbol position is adjacent to a wild symbol 806 positioned in an active symbol position 802 at R7C3.

Accordingly, outcome evaluator 623 determines that the alignment test once again holds true and sends a message to game area expander 622B to expand the game area 904.

In one embodiment, game area expander 622B again sends a message to display controller 625, which causes an animation to be displayed on display 54, as illustrated in FIG. 10C. That is, arrow object 1002 is displayed on display 54 indicating the direction and magnitude of expansion of game area 904.

Game area expander 622B continues expanding game area 904 until the alignment test fails. Thus in the embodiment of FIG. 10C, Game area expander 622B continues expanding game area 904 until the expanded game area is defined by a 10×4 grid layout.

At this point, since there are no more wild symbols 806 positioned in a non-active symbol position aligned with a wild symbol 806 positioned in an active symbol position 802, the alignment test fails and expansion of the game area ends. That is, referring to FIGS. 6 and 7, outcome evaluator 623 determines that the end condition is satisfied at step 710, evaluates the symbols selected for positioning in active symbol positions 802, pays any awards due based on predefined pay table 643 and returns control back to step 702.

In these examples, it is assumed that the expansion limit is set at 13 rows. Thus in this embodiment, no further expansion is possible once the expanded game area reaches a 13×4 grid layout, irrespective of the alignment test. In other embodiments, the expansion limit may be set at another level, use different criteria or expansion may not be limited in such a manner.

As indicated above, the method may be embodied in program code. The program code could be supplied in a number of ways, for example on a tangible computer readable storage medium, such as a disc or a memory device, e.g. an EEPROM, (for example, that could replace part of memory 103) or as a data signal (for example, by transmitting it from a server). Further, different parts of the program code can be executed by different devices, for example in a client server relationship. Persons skilled in the art, will appreciate that program code provides a series of instructions executable by the processor.

It is to be understood that, if any prior art is referred to herein, such reference does not constitute an admission that the prior art forms a part of the common general knowledge in the art in any country.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. A gaming machine comprising:

a display device configured to present an arrangement of symbol positions, wherein a subset of the symbol positions are designated as active symbol positions;

a game controller configured to:

populate the symbol positions, each with a randomly selected symbol;

determine whether at least one of the randomly selected symbols in the active symbol positions matches an adjacent randomly selected symbol not in the active symbol positions;

expand the subset of active symbol positions to include one or more additional symbol positions based on a determination that the at least one of the randomly selected symbols in the active symbol positions matches the adjacent randomly selected symbol not in the active symbol positions; and determine a game outcome based at least in part on symbols displayed in the expanded active symbol positions.

2. The gaming machine of claim 1, wherein the symbol positions are included on a first reel or a second reel, the first reel and the second reel being displayed on the display device such that at least one symbol position from each reel is active and is viewable in a game area, and such that at least one symbol position from each reel is non-active and is not viewable in the game area.

3. The gaming machine of claim 2, wherein the game controller is configured to expand the subset of active symbol positions, such that at least one non-active symbol position from each reel that is not viewable in the game area becomes active and becomes viewable in the game area.

4. The gaming machine of claim 1, wherein the game controller is configured to continue to expand the subset of active symbol positions until at least one predefined ending criterion is satisfied.

5. The gaming machine of claim 4, wherein the game controller is configured to determine that the predefined ending criterion is satisfied when no symbol in the active symbol positions is adjacent to a matching symbol not in the active symbol positions.

6. The gaming machine of claim 4, wherein the predefined ending criterion is satisfied when the game controller determines that a predefined expansion limit has been reached, wherein the expanding continues until the predefined expansion limit is reached.

7. The gaming machine of claim 1, wherein the at least one of the randomly selected symbols in the active symbol positions that matches the adjacent randomly selected symbol not in the active symbol positions are predetermined symbols.

8. The gaming machine of claim 7, wherein the predetermined symbols are function symbols.

9. The gaming machine of claim 1, wherein the symbol positions are arranged in a matrix of rows and columns.

10. A method of playing a game on a gaming machine, the gaming machine comprising a game controller and a display device configured to present a plurality of symbol positions comprising a plurality of active symbol positions within a game area and a plurality of non-active symbol positions outside of the game area, the method comprising:

populating, by the game controller, each symbol position of the plurality of symbol positions with a symbol selected from a plurality of symbols;

determining, by the game controller, whether the symbol provided in at least one non-active symbol position is adjacent to a same symbol provided in at least one active symbol position;

expanding, by the game controller, the game area to generate an expanded game area based on a determination that the symbol provided in the at least one non-active symbol position is adjacent to the same symbol provided in the at least one active symbol position, wherein the expanded game area is generated by changing, to active symbol positions, a row or a column of the non-active symbol positions occupied by the at least one non-active symbol position having the symbol adjacent to the same symbol provided in the at least one active symbol position; and determining, by the game controller a game outcome based at least in part on symbols displayed in the expanded game area.

11. The method of claim 10, wherein the plurality of symbol positions are included on a first reel or a second reel, the first reel and the second reel being displayed on the display device such that at least one symbol position from each reel is active and is viewable in the game area, and such that at least one symbol position from each reel is non-active and is not viewable in the game area.

12. The method of claim 11, comprising expanding the game area such that at least one non-active symbol position from each reel that is not viewable in the game area becomes active and becomes viewable in the expanded game area.

13. The method of claim 10, wherein the expanding the game area continues until at least one predefined ending criterion is satisfied.

14. The method of claim 13, comprising determining, by the game controller, that the predefined ending criterion is satisfied when no symbol included in any non-active symbol position is adjacent to the same symbol provided in any active symbol position.

15. The method of claim 13, comprising determining, by the game controller, that the predefined ending criterion is satisfied when a predefined expansion limit has been reached, wherein the expanding continues until the predefined expansion limit is reached.

16. The method of claim 10, wherein the symbol provided in at least one non-active symbol position that is adjacent to the same symbol provided in the at least one active symbol position are predetermined symbols.

17. The method of claim 16, wherein the predetermined symbols are function symbols.

18. The method of claim 10, wherein the symbol positions are arranged in a matrix of rows and columns.

19. A method comprising:

providing an arrangement of symbol positions arranged in rows and columns, wherein a subset of the symbol positions are designated as active symbol positions;

populating the symbol positions, each with a randomly selected symbol;

determining whether at least one of the randomly selected symbols in the active symbol positions matches an adjacent randomly selected symbol not in the active symbol positions;

expanding the subset of active symbol positions to include one or more additional symbol positions based on a determination that at least one of the randomly selected symbols in the active symbol positions matches an adjacent randomly selected symbol not in the active symbol positions; and determining a game outcome based at least in part on symbols displayed in the expanded active symbol positions.

* * * * *